US006073807A

United States Patent [19]

Wilford et al.

[11] Patent Number: 6,073,807

[45] Date of Patent: Jun. 13, 2000

[54] FLEXIBLE CONTAINER WITH EVACUATION FORM INSERT

[75] Inventors: Michael Wilford, Downers Grove, Ill.; Christopher C. Rutter, Oakland; Lamar Spalding, Hayward, both of Calif.

[73] Assignee: Packaging Systems, Inc., Romeoville, Ill.

[21] Appl. No.: 09/195,323

[22] Filed: Nov. 18, 1998

[51] Int. Cl.[7] ..... B65D 35/56

[52] U.S. Cl. ..... 222/105; 222/464.3

[58] Field of Search ..... 222/105, 566, 222/464.1, 464.2, 464.3

[56] References Cited

U.S. PATENT DOCUMENTS

| | | | |
|---|---|---|---|
| 4,601,410 | 7/1986 | Bond | 222/105 |
| 5,647,511 | 7/1997 | Bond | 222/105 |
| 5,749,493 | 5/1998 | Boone et al. | 222/105 |
| 5,941,421 | 8/1999 | Overman et al. | 222/105 |

*Primary Examiner*—Philippe Derakshani
*Attorney, Agent, or Firm*—Wallenstein & Wagner, Ltd.

[57] ABSTRACT

A collapsible bag having opposed sidewalls for containing and dispensing liquid including a spout attached to a sidewall and having a spout axis, a sidewall axis extending through a central portion of the spout dividing the container into separate portions, and a fluid passage member secured to a sidewall and extending in a direction perpendicular to the spout axis and having a portion spaced a distance from the sidewall axis.

18 Claims, 2 Drawing Sheets

FLEXIBLE CONTAINER WITH EVACUATION FORM INSERT

TECHNICAL FIELD

The present invention relates generally to bulk material containers and specifically to collapsible, sealed containers with an internal element.

BACKGROUND OF THE INVENTION

Collapsible plastic bags are often used to store liquid products such as chemicals, soft drink syrup, and food condiments. The plastic bags are typically housed in a container or box to aid in handling and dispensing of the product. Such bags are referred to in the art as "bag-in-box bags."

The plastic bags also have a spout for filling and dispensing the product within the bag. Generally, to dispense product from bag-in-box bags, vacuum pump systems are often utilized. To aid in dispensing product from the container, evacuation channels are often placed within the bag. Evacuation channels are typically elongate cylindrical tubes or flat strips with protruding ribs defining grooves. Typically, one end of the evacuation channel is disposed transverse to, or is connected to the spout, and the other end of the evacuation channel extends into the cavity of the bag. As the bag is emptied by the force of the vacuum pump, portions of the bag collapse unevenly, tending to leave pockets of product, typically liquid, which may become isolated from the rest of the liquid in the container. The evacuation channel, however, forms a conduit which cannot be closed off by the vacuum pressure on the walls of the bag. In this manner the entire chamber of the flexible bag remains in communication with the spout at all times during the dispensing such that all product within the bag can be removed.

Prior attempts to provide such bags are disclosed in U.S. Pat. Nos. 4,601,410; 5,647,511 and 5,749,493. U.S. Pat. Nos. 4,601,410 and 5,647,511 disclose a liquid container with an evacuation unit. In both the '410 and '511 patents, the evacuation unit is shown attached directly to the spout by a mounting ring. Several problems have been encountered with these types of evacuation units. For example, during the filling process, which is typically done in a high speed and high pressure process, the evacuation unit is susceptible of being dislodged from the spout thereby rendering the evacuation unit inoperative. Also, the attaching ring can impede the flow of liquid during the filling process thereby slowing the filling process.

U.S. Pat. No. 5,749,493 discloses an evacuation unit positioned within a bag and transverse and perpendicular to a spout in the bag. Because the evacuation unit is positioned in a location that is in line with the incoming fluid during the filling process, it is susceptible of being dislodged from its mounting to the container thereby rendering it ineffective.

Other designs and configurations, beyond the three enumerated above, have been utilized by the flexible container industry but those designs have a number of inherent flaws. Foremost among those problems is the requirement of manual insertion of the evacuation channel after the container has been filled with liquid contents. This is highly undesirable because it adds another step to the manufacturing process and increases the labor costs.

For the aforementioned reasons, it is desirable to produce a flexible container with an evacuation channel that does not readily become dislodged during the filling step and does not significantly interfere with the rate of filling the container.

SUMMARY OF THE INVENTION

The present invention provides a flexible container with a fluid passage member that may be used for the shipment, storage and dispensing of bulk material.

According to the present invention, a flexible container is provided comprising a spout attached to a container sidewall. The spout has a spout axis, which is a line through the center point of the spout. The container sidewalls form the shape and volume of the container and feature a sidewall axis. The sidewall axis is a line that extends through the central portion of the spout and in the same plane as the sidewall. The sidewall axis effectively divides the container sidewall into separate portions. In the preferred form, the spout is affixed directly in the center of a sidewall and as a result, the sidewall axis divides that container sidewall into two equivalent portions. A fluid passage member is secured to the internal surface of a container sidewall. The member is affixed perpendicular to the spout axis and a portion of the member is spaced a distance from the sidewall axis. In the preferred form, the fluid passage member is attached at one end to the internal surface of the same sidewall as the spout.

The present invention also provides for flexible material container where the entire length of the fluid passage member is mounted and spaced a distance from the sidewall axis.

In another form, the fluid passage member can be secured to the sidewall at one end, at both ends, at an intermediate position, or throughout its entire length.

In an alternate form, the fluid passage member can be secured to the internal surface of the sidewall opposite the spout.

In yet another form, the spout can be mounted off-center, meaning that the spout is not positioned at the midpoint of the container sidewall. In this configuration, the sidewall axis divides the container into non-equivalent portions.

Further scope of applicability of the present invention will become apparent from the detailed description given hereafter. However, it should be understood that the detailed description and the specific examples, while indicating preferred embodiments of the invention are given by way of illustration only, sine various changes and modifications with the spirit of the invention will become apparent to those skilled in the art from this detailed description.

DETAILED DESCRIPTION

Figure 1:
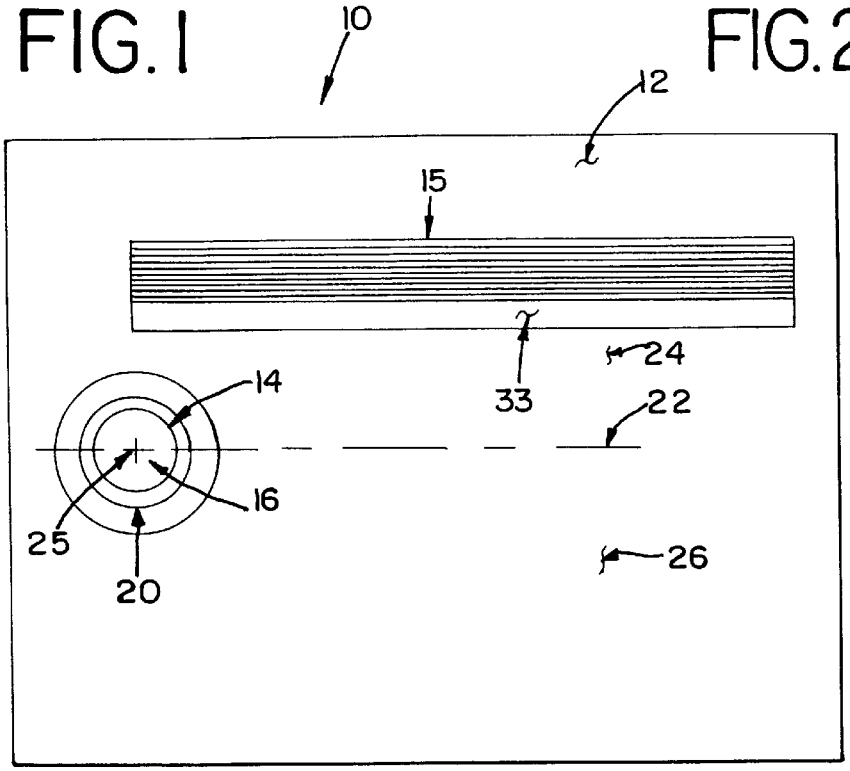
FIG. 1 is a plan view of the evacuation container of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
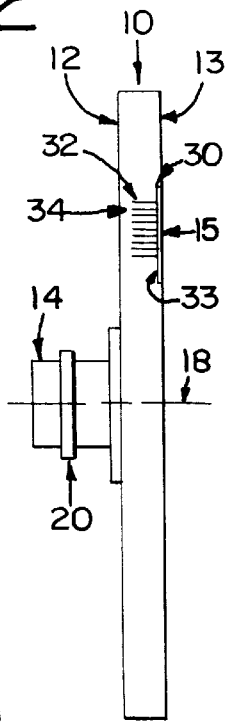
FIG. 2 is a side view of the evacuation strip of FIG. 1.

FIGS. 1 and 2 show a flexible container assembly 10 having a first sidewall 12 and a second sidewall 13 attached at peripheral edges, a spout 14 attached to the sidewall 12 and an evacuation unit 15. In a preferred form, the first and second sidewalls 12 and 13 are a flexible polymeric material having a modulus of elasticity of less than 50,000 psi. The sidewalls preferably are made from materials such as homopolymers and copolymers of polyolefins, polyamides, polyesters or other material that are capable of being sealed using standard conduction sealing techniques. The sidewalls may be multilayered or single layered and may be fabricated from any suitable polymer processing technology including extrusion, lamination or other.

The spout 14 has a spout opening 16, a spout axis 18, and a spout flange 20 circumjacent the spout opening 16. The spout flange 20 provides a surface for attaching the spout 14 to the container assembly 10. The spout 14 may also be fabricated from polymeric materials including polyolefins, polyamides, polyesters, polycarbonates and other material that is capable of being sealed to one of the sidewalls 12, 13 of the container assembly 10. The spout 14 may be fabricated using injection molding techniques or other suitable polymer processing techniques.

Of course, the spout 14 may be attached to the first or second sidewall 12, 13 or both and may be located at any location thereon. A sidewall axis 22 extends axially through a center point 25 of the spout 14 and in the same plane as the first sidewall 12. The sidewall axis 22 divides the container 10 into two separate portions 24, 26.

The evacuation unit 15 is preferably flexible and fabricated from a polymeric material. Suitable polymeric materials include polyolefins, polyamides, polyesters or other material that is capable of being sealed to at least one sidewall of the container. The evacuation unit 15, in a preferred form, is fabricated using extrusion processing techniques. However, it is contemplated that other polymer processing techniques could be used such as injection molding or lamination without departing from the scope of the present invention.

The evacuation unit 15 has a generally rectangular shape with a flat backbone 30, a plurality of longitudinally extending and horizontally spaced groove walls 32 defining grooves 34 between adjacent groove walls 32. FIG. 1 shows nine groove walls 32, however, any number of groove walls could be utilized without departing from the scope of the present invention. The groove walls 32 are dimensioned to have sufficient height to maintain a fluid passage even when a sidewall may be drawn to the evacuation unit during dispensing of the contents of the container. Adjacent the groove walls is a flange area 33 for being heat sealed to the container sidewalls.

The evacuation unit 15 may be sealed to either sidewall 12, 13 at any location along the length of the evacuation unit 15. In a preferred form, the evacuation unit 15 is attached at an end portion of the unit 15 adjacent the spout to the first sidewall 12, the same sidewall as where the spout is attached. It is also possible to seal the evacuation unit 15 along its entire length to one of the sidewalls 12, 13. It is also contemplated that more than one evacuation unit 15 could be utilized.

The evacuation unit 15 is positioned in the container to minimize interference with incoming fluid during the filling process. For this reason, the evacuation unit 15 is positioned such that as much of the evacuation unit 15 as possible remains with the portion 24 and does not cross the sidewall axis 22 into the portion 26. Preferably, 50% of the length of the evacuation unit 15 will not cross the sidewall axis 22 into the portion 26, more preferably greater than 75% of the length, even more preferably greater than 90% of the length and most preferably 100% of the length, or any range of combination of ranges therein. It has been found by the present inventors that positioning the evacuation unit as shown in FIGS. 1 thru 4 greatly minimizes the occurrence of the evacuation unit being dislodged during the fluid filling step when compared with prior art evacuation units having the evacuation unit in line with the sidewall axis.

Figure 3:
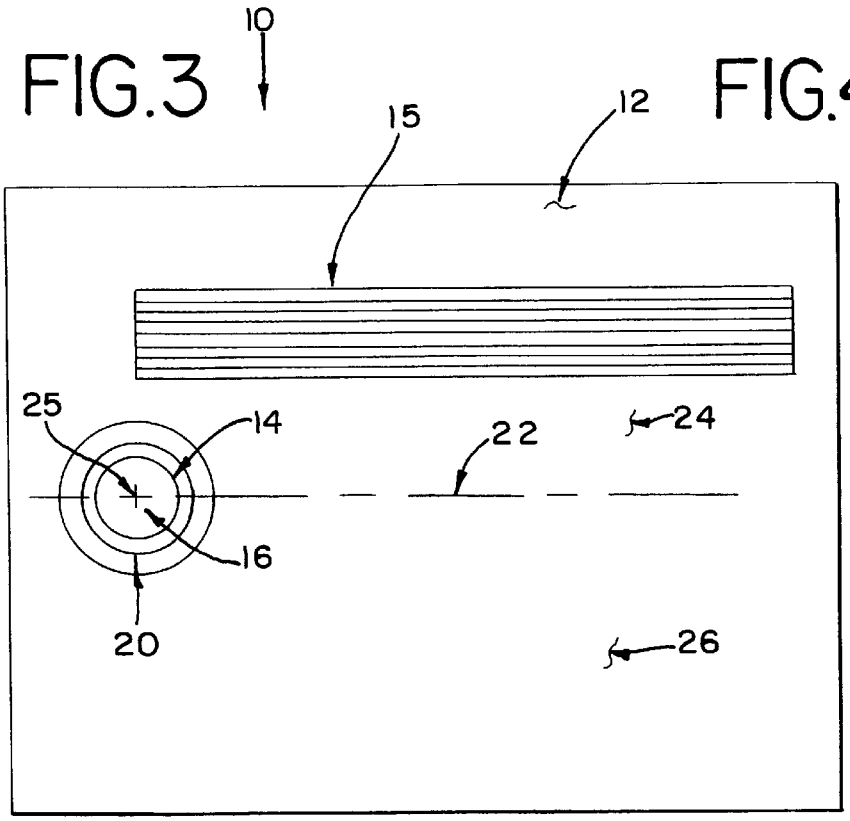
FIG. 3 is a plan view of an alternate container of the present invention.
Figure 4:
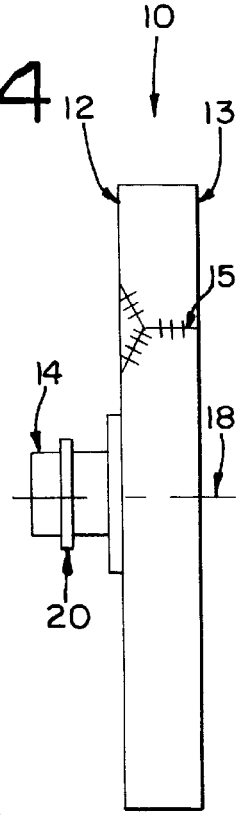
FIG. 4 is a side view of the evacuation strip of FIG. 3.
Figure 5:
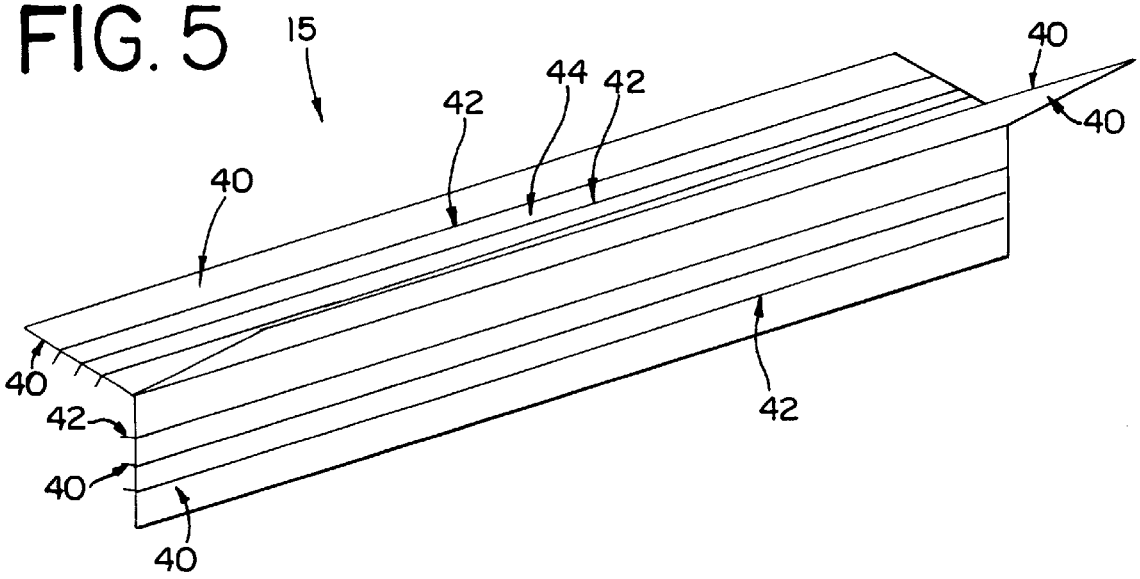
FIG. 5 is a perspective view of the evacuation strip of FIG. 3.

FIGS. 3, 4 and 5 show another embodiment of the evacuation unit 15 having a generally Y-shape. As shown in FIG. 5, the Y-shape has six surfaces 40 each of which has longitudinally extending groove walls 42 and grooves 44 as in the first embodiment. This Y-shaped evacuation unit 15 is believed to be more effective than the first embodiment in draining sugar rich syrup.

While the specific embodiments have been illustrated and described, numerous modifications come to mind without significantly departing from the spirit of the invention and the scope of protection is only limited by the scope of the accompanying claims.

We claim:

1. A collapsible bag having opposed sidewalls for containing and dispensing liquid comprising:

a spout attached to a sidewall and having a spout axis;

a sidewall axis extending through a central portion of the spout dividing the container into separate portions; and, a fluid passage member secured to a sidewall and extending in a direction perpendicular to the spout axis and having a portion spaced a distance from the sidewall axis.

2. The device of claim 1 wherein the fluid passage member is capable of preventing a bag wall from collapsing against the member during fluid removal, such that the second bag wall cannot impede fluid flow near the spout and prevent evacuation of the liquids.

3. The device of claim 1 wherein the fluid passage member is secured to a sidewall at one end.

4. The device of claim 1 wherein the fluid passage member is secured to a sidewall at opposite ends.

5. The device of claim 1 wherein the fluid passage member is secured to a sidewall at an intermediate position.

6. The device of claim 1 wherein the fluid passage member is secured to a sidewall along its entire length.

7. The device of claim 1 wherein the fluid passage member is secured to the same sidewall as the spout.

8. The device of claim 1 wherein the fluid passage member is secured to the sidewall opposite the spout.

9. The device of claim 1 wherein the entire length of the fluid passage member is spaced a distance from the sidewall axis.

10. A collapsible bag having opposed sidewalls for containing and dispensing liquid comprising:

a spout attached to a sidewall and having a spout axis;

a sidewall axis extending through a central portion of the spout dividing the container into separate portions; and a fluid passage member secured to a sidewall and extending in a direction perpendicular to the spout axis with the entire length of the fluid passage member spaced a distance from the sidewall axis.

11. The device of claim 10 wherein the fluid passage member is capable of preventing a bag wall from collapsing against the member during fluid removal, such that the second bag wall cannot impede fluid flow near the spout and prevent evacuation of the liquids.

12. The device of claim 10 wherein the fluid passage member is secured to a sidewall at one end.

13. The device of claim 10 wherein the fluid passage member is secured to a sidewall at opposite ends.

14. The device of claim 10 wherein the fluid passage member is secured to a sidewall at an intermediate position.

15. The device of claim 10 wherein the fluid passage member is secured to a sidewall along its entire length.

16. The device of claim 10 wherein the fluid passage member is secured to the same sidewall as the spout.

17. The device of claim 10 wherein the fluid passage member is secured to the sidewall opposite the spout.

18. The device of claim 10 wherein the sidewall axis is perpendicular to and transverse to the spout axis.

* * * * *